US012214398B2

(12) United States Patent
Mills

(10) Patent No.: US 12,214,398 B2
(45) Date of Patent: Feb. 4, 2025

(54) ROLL-FORMING TOOL FOR CREATING A NONCIRCULAR FEATURE, METHOD OF CREATING A NONCIRCULAR FEATURE, AND METHOD OF ASSEMBLING A PUMP HAVING A NONCIRCULAR JOINT

(71) Applicant: HANON SYSTEMS EFP CANADA LTD., Concord (CA)

(72) Inventor: Kyle D. Mills, Etobicoke (CA)

(73) Assignee: Hanon Systems EFP Canada Ltd., Concord (CA)

( * ) Notice: Subject to any disclaimer, the term of this patent is extended or adjusted under 35 U.S.C. 154(b) by 981 days.

(21) Appl. No.: 16/972,059

(22) PCT Filed: Mar. 28, 2019

(86) PCT No.: PCT/IB2019/052563
§ 371 (c)(1),
(2) Date: Dec. 4, 2020

(87) PCT Pub. No.: WO2019/239224
PCT Pub. Date: Dec. 19, 2019

(65) Prior Publication Data

US 2021/0170469 A1 Jun. 10, 2021

Related U.S. Application Data

(60) Provisional application No. 62/683,222, filed on Jun. 11, 2018.

(51) Int. Cl.
*B21D 19/04* (2006.01)
*B21D 39/02* (2006.01)
(Continued)

(52) U.S. Cl.
CPC ..... *B21D 19/046* (2013.01); *B21D 39/02* (2013.01); *F04D 29/60* (2013.01); *B21D 51/32* (2013.01)

(58) Field of Classification Search
CPC ..... B21D 19/046; B21D 19/16; B21D 19/04; B21D 19/043; B21D 22/14; B21D 22/16;
(Continued)

(56) References Cited

U.S. PATENT DOCUMENTS 2,159,852 A 5/1939 Homeier
3,639,961 A 2/1972 Shiflet
(Continued)

FOREIGN PATENT DOCUMENTS

CN 103495632 A 1/2014
JP 2000079426 A 3/2000
(Continued)

OTHER PUBLICATIONS

Extended European Search Report regarding EP 19818755.1, dated Feb. 10, 2022.
(Continued)

*Primary Examiner* — Jared O Brown
(74) *Attorney, Agent, or Firm* — Harness, Dickey & Pierce, P.L.C.

(57) ABSTRACT

A tool for roll-forming a noncircular lip of a component includes a central shaft, first and second axles, and first and second rollers. The central shaft has a longitudinal axis. The central shaft is adapted to rotate about the longitudinal axis. The axles extend from and are fixed to the central shaft. The axles have respective first and second lateral axes that extend substantially perpendicular to the longitudinal axis. The rollers are rotatably coupled to respective axles, adapted to rotate about the respective lateral axes, radially spaced with respect to the longitudinal axis, and circumferentially spaced with respect to each other. The first and second rollers are adapted to concurrently operably engage the noncircular lip, and deform the noncircular lip.

13 Claims, 6 Drawing Sheets

(51) Int. Cl.
*F04D 29/60* (2006.01)
*B21D 51/32* (2006.01)

(58) Field of Classification Search
CPC ..... B21D 22/18; B21D 39/023; B21D 39/10; B21D 39/12; B21D 41/023; B21D 51/32; B31F 1/0087; B31F 1/009; B31F 1/0038
See application file for complete search history.

(56) References Cited

U.S. PATENT DOCUMENTS

| | | | | |
|---|---|---|---|---|
| 4,357,138 | A * | 11/1982 | Johnson | B31F 1/009 493/159 |
| 4,861,400 | A * | 8/1989 | Sargent | B29C 66/8362 156/582 |
| 2016/0146220 | A1* | 5/2016 | Chaggar | B21D 39/04 492/1 |

FOREIGN PATENT DOCUMENTS

| | | | |
|---|---|---|---|
| JP | 2002178043 | A | 6/2002 |
| JP | 2003251415 | A | 9/2003 |
| SU | 1750787 | A1 * | 7/1992 |

OTHER PUBLICATIONS

Korean Office Action regarding Application No. 10-2021-7000226, dated Jan. 3, 2022.
Chinese Office Action regarding Application No. 2019800343587, dated May 6, 2022.
Chinese Office Action regarding Patent Application No. 2019800343587, dated Nov. 28, 2023.

* cited by examiner

ROLL-FORMING TOOL FOR CREATING A NONCIRCULAR FEATURE, METHOD OF CREATING A NONCIRCULAR FEATURE, AND METHOD OF ASSEMBLING A PUMP HAVING A NONCIRCULAR JOINT

CROSS-REFERENCE TO RELATED APPLICATIONS

This application is a U.S. National Phase Application under 35 U.S.C. 371 of International Application No. PCT/IB2019/052563, filed on Mar. 28, 2019, which claims the benefit of U.S. Provisional Application No. 62/683,222, filed on Jun. 11, 2018. The entire disclosures of the above applications are incorporated herein by reference.

FIELD

The present disclosure relates to a roll-forming tool for creating a noncircular feature such as a joint, a method of creating a noncircular feature such as a joint using the roll-forming tool, and a method of assembling a pump having a noncircular joint.

BACKGROUND

This section provides background information related to the present disclosure which is not necessarily prior art.

Roll-forming, which involves the continuous deformation of a material by two or more rollers, can be used to form enclosed joints. Such roll-formed joints may be used on pumps, such as to retain bearings and/or motor stators, by way of example. To create the roll-formed joint, two or more rollers can be revolved about a central axis to continuously engage a circular lip to deform a first component to engage a second component, thereby forming a joint. However, some joints interconnect components along a noncircular path. The shape of the component periphery is something other than a circle and the joint may be identified as noncircular. The rollers of the roll-forming machine are unable to maintain continuous and concurrent engagement with the component to be deformed as they revolve about the central axis. Instead of the method described above, noncircular roll-formed joints may be created through use of a complicated tool that follows the shape of a profile of the component rather than remaining stationary with respect to the central axis.

SUMMARY

This section provides a general summary of the disclosure, and is not a comprehensive disclosure of its full scope or all of its features.

In various aspects, the subject disclosure provides a method of deforming a noncircular lip. The method includes rotating a roll-forming tool about a longitudinal axis. The roll-forming tool includes a central shaft, a first axle, a second axle, a first roller, and a second roller. The central axis extends along the longitudinal axis. The first axle has a first lateral axis that extends substantially perpendicular to the longitudinal axis. The second axle has a second lateral axis that extends substantially perpendicular to the longitudinal axis. The first roller is rotatably coupled to the first axis and adapted to rotate about the first lateral axis. The second roller is rotatably coupled to the second axis and adapted to rotate about the second lateral axis. The first and second rollers are radially positioned with respect to the longitudinal axis and circumferentially spaced with respect to each other. While rotating the roll-forming tool, the first and second rollers are engaged with the noncircular lip. The method further includes applying a load to the noncircular lip. The load is applied parallel to the longitudinal axis. The method further includes continuing rotating the roll-forming tool about the longitudinal axis. The longitudinal axis remains in a fixed position. Rotating the roll-forming tool causes the first and second rollers to concurrently operably engage the noncircular lip and deform the noncircular lip.

In other aspects, the subject disclosure provides a method of assembling a cover to a housing of a pump. The method includes disposing a noncircular plate within a cavity. The cavity is at least partially defined by a noncircular lip. The method further includes rotating a roll-forming tool about a longitudinal axis. The roll-forming tool includes a central shaft, a first axle, a second axle, a first roller, and a second roller. The central shaft extends along the longitudinal axis. The first axle includes a first lateral axis that extends substantially perpendicular to the longitudinal axis. The second axle includes a second lateral axis that extends substantially perpendicular to the longitudinal axis. The first roller is rotatably coupled to the first axle and adapted to rotate about the first lateral axis. The second roller is rotatably coupled to the second axle and adapted to rotate about the second lateral axis. The first and second rollers are radially positioned with respect to the longitudinal axis and circumferentially spaced with respect to each other. While rotating the roll-forming tool, the first and second rollers are engaged with the noncircular lip. The method further includes applying a load to the noncircular lip. The load is applied parallel to the longitudinal axis. The method further includes continuing rotating the roll-forming tool about the longitudinal axis. The longitudinal axis remains in a fixed position. Rotating the roll-forming tool causes the first and second rollers to concurrently operably engage the noncircular lip, deform the noncircular lip, and assemble the cover to the housing.

In other aspects, the subject disclosure provides a tool for roll-forming a noncircular lip of a component. The tool includes a central shaft, a first axle, a second axle, a first roller, and a second roller. The central shaft has a longitudinal axis. The central shaft is adapted to rotate about the longitudinal axis. The first and second axles extend from and is fixed to the central shaft. The first axle has a first lateral axis that extends substantially perpendicular to the longitudinal axis. The second axle has a second lateral axis that extends substantially perpendicular to the longitudinal axis. The first roller is rotatably coupled to the first axle and adapted to rotate about the first lateral axis. The second roller is rotatably coupled to the second axle and adapted to rotate about the second lateral axis. The first and second rollers are radially spaced with respect to the longitudinal axis and circumferentially spaced with respect to each other. The first and second rollers are adapted to concurrently operably engage the noncircular lip, and deform the noncircular lip.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
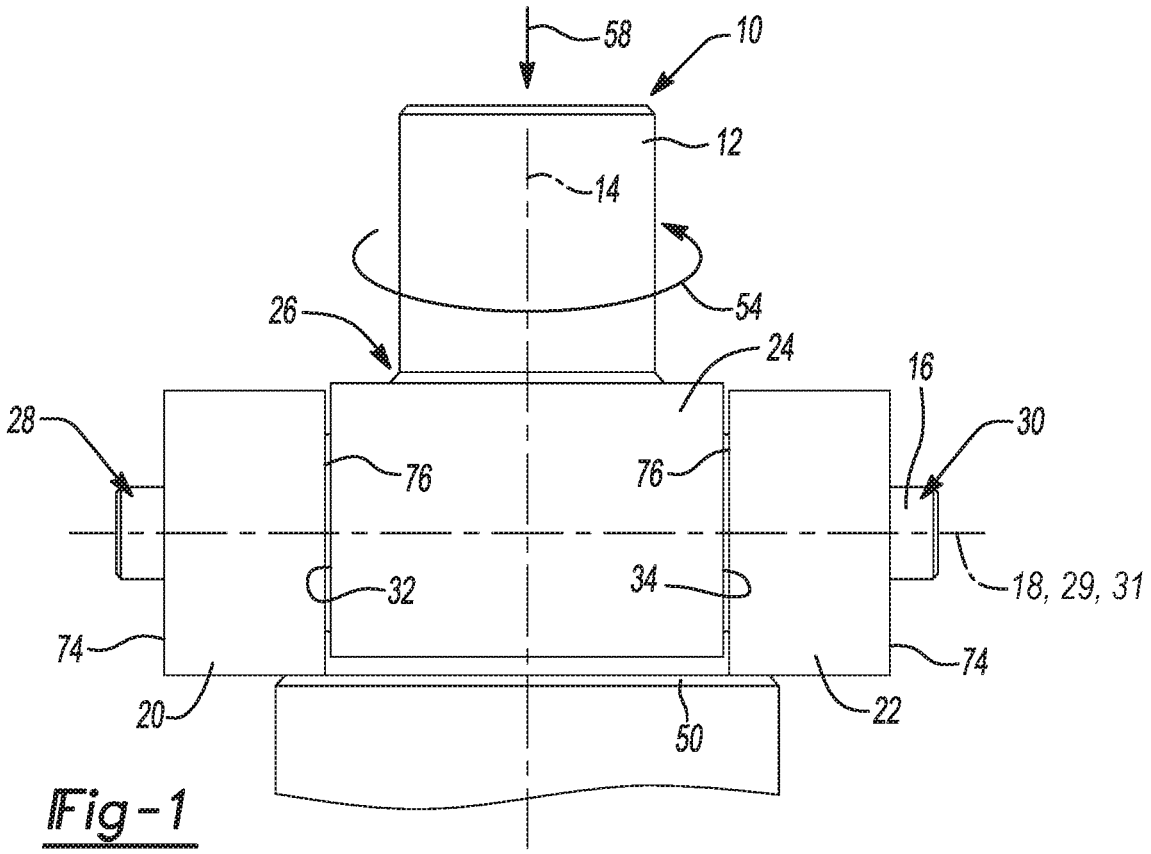
FIG. 1 is a side view of a roll-forming tool engaging a noncircular lip according to certain aspects of the present disclosure.
Figure 2:
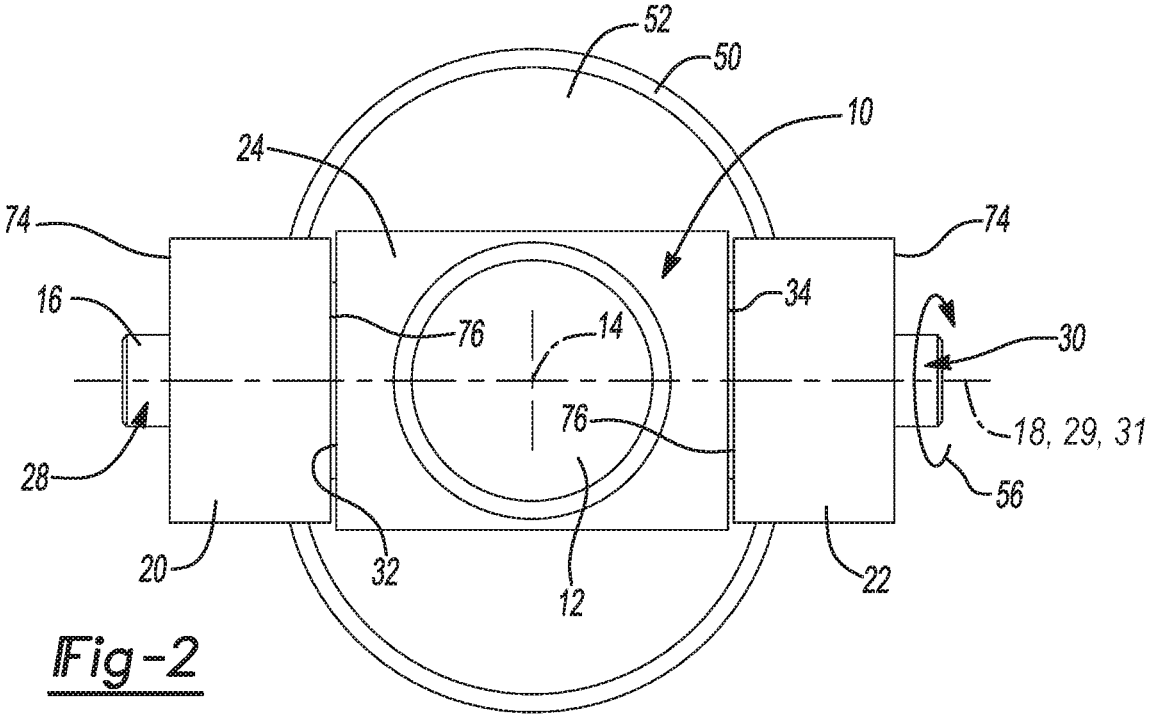
FIG. 2 is a top view of the roll-forming tool of FIG. 1 engaging a first portion of the noncircular lip.

Example embodiments will now be described more fully with reference to the accompanying drawings.

In various aspects, the present disclosure provides a tool for creating a noncircular roll-formed feature, such as a joint. The tool includes at least two rollers that are wide enough to accommodate both the narrowest and widest dimensions of the noncircular feature. The present disclosure also provides a method of roll-forming a noncircular feature and a method of assembling a pump that includes a noncircular joint. Compared to the typical method of following the shape of the noncircular feature with a complex tool, the methods of the present disclosure are quicker, cheaper, and easier to automate.

With reference to FIGS. 1-4, a roll-forming tool 10 according to certain aspects of the present disclosure is provided. The roll-forming tool 10 may include a central shaft 12 that extends along a longitudinal axis 14. The roll-forming tool 10 may further include an axle 16 that extends along a lateral axis 18. The lateral axis 18 of the axle 16 may extend substantially perpendicular to the longitudinal axis 14 of the central shaft 12. In various aspects, both the central shaft 12 and the axle 16 are substantially cylindrical.

The roll-forming tool 10 may also include first and second wheels or rollers 20, 22. In various aspects, the first and second rollers 20, 22 may be referred to as "the rollers." The rollers 20, 22 may be rotatably coupled to the axle 16 and adapted to rotate with respect to the axle 16. More particularly, the rollers 20, 22 may be adapted to rotate about the lateral axis 18. The rollers 20, 22 may be radially positioned with respect to the longitudinal axis 14. The rollers 20, 22 may be disposed equidistant from the longitudinal axis 14 of the central shaft 12. The rollers 20, 22 may be circumferentially spaced with respect to each other. The first and second rollers 20, 22 may be equally spaced about a circumference of a circle traced by the rollers 20, 22 when the roll-forming tool 10 is rotated about the longitudinal axis 14. In various aspects, the first roller 20 and the second roller 22 are substantially identical.

The roll-forming tool 10 may further include a base 24 disposed at a distal end 26 (FIG. 1) of the central shaft 12. The base 24 may be laterally centered with respect to the longitudinal axis 14. The axle 16 and the base 24 may be fixed with respect to the central shaft 12. In various aspects, the axle 16 and the base 24 are integrally formed with the central shaft 12.

The axle 16 may include a first portion 28 having a first axis 29, and a second portion 30 having a second axis 31. The first axis 29 and the second axis 31 are collinear with each other and the lateral axis 18. The first and second portions 28, 30 may project from opposing first and second sides 32, 34 of the base 24. In various aspects, the first and second portions 28, 30 may be referred to as first and second axles, respectively. The first and second axes 29, 31 may be referred to as first and second lateral axes, respectively.

The first roller 20 may be rotatably coupled to the first portion 28 of the axle 16. The second roller 22 may be rotatably coupled to the second portion 30 of the axle 16. The rollers 20, 22 may be laterally fixed to prevent translation along the lateral axis 18 of the axle 16. In various aspects, inward movement (i.e., toward the longitudinal axis 14) of the rollers 20, 22 may be at least partially limited by the base 24.

The rollers 20, 22 can continuously and concurrently engage a noncircular feature, such as a noncircular lip 50. In one example, the lip 50 is roll-formed around a noncircular plate 52 (FIG. 2) to create a noncircular joint and retain the plate 52. The central shaft 12 can be rotated about the longitudinal axis 14 in a first rotational direction 54 (FIG. 1). When the rollers 20, 22 engage the noncircular lip 50, rotation of the central shaft 12 about the longitudinal axis 14 causes the rollers 20, 22 to rotate in a second rotational direction 56 (FIG. 2) about the lateral axis 18. A load may be applied in a downward direction 58 (FIG. 1) so that operable engagement of the rollers 20, 22 with the noncircular lip 50 causes the noncircular lip 50 to deform.

Figure 3:
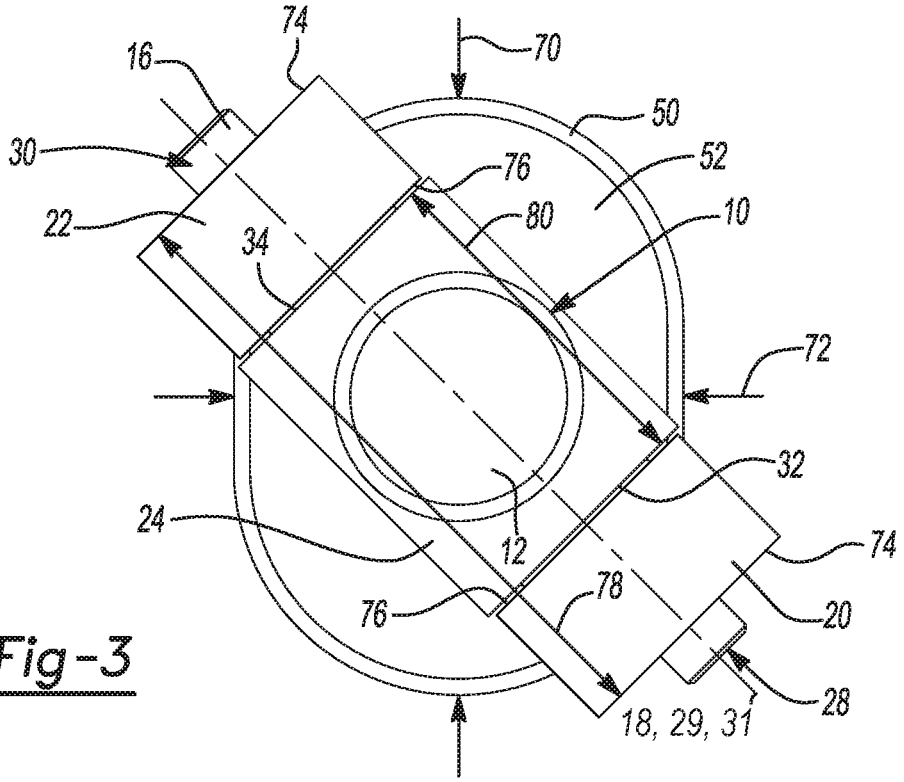
FIG. 3 is a top view of the roll-forming tool of FIG. 1 engaging a second portion of the noncircular lip.
Figure 4:
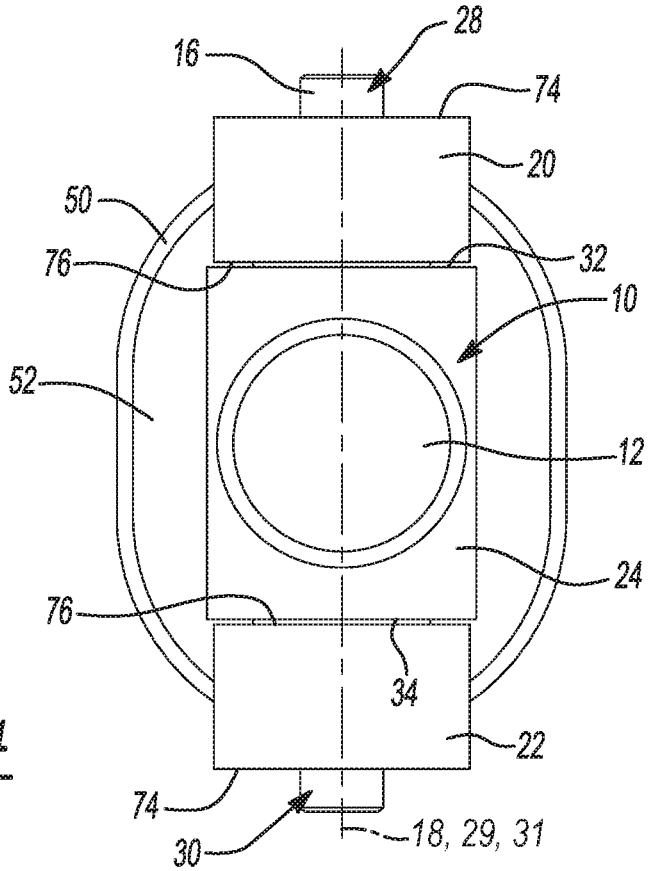
FIG. 4 is a top view of the roll-forming tool of FIG. 1 engaging a third portion of the noncircular lip.

The rollers 20, 22 may be wide enough parallel to the lateral axis 18 to bridge a narrowest portion of a profile of the noncircular lip 50 (see, e.g., FIG. 2), an intermediate portion of the profile of the noncircular lip 50 (FIG. 3), and a widest portion of the profile of the noncircular lip 50 (see, e.g., FIG. 4). Thus, the longitudinal axis 14 may remain fixed while the first roller 20 and the second roller 22 concurrently engage the noncircular lip 50 through an entire rotation of the roll-forming tool 10 (i.e., a 360° rotation of the central shaft 12 about the longitudinal axis 14). Unlike the typical method of following the noncircular profile with a complex tool having a non-stationary longitudinal axis (not shown), the roll-forming tool 10 of the present disclosure can be used to form a noncircular joint while the longitudinal axis 14 remains fixed and the rollers 20, 22 have a circular orbit about the longitudinal axis 14.

With reference to FIG. 3, the noncircular lip 50 may at least partially define a first dimension 70 substantially perpendicular to the longitudinal axis 14. The noncircular lip may at least partially define a second dimension 72 substantially perpendicular to the longitudinal axis 14. The first dimension 70 may be greater than the second dimension 72. In one example, the first and second dimensions 70, 72 are substantially perpendicular to one another. In various aspects, the first dimension 70 is a maximum dimension and the second dimension 72 is a minimum dimension. In various aspects, a ratio of the first dimension 70 to the second dimension 72 is greater than 1, optionally greater than or equal to 1.05, optionally greater than or equal to 1.1, optionally greater than or equal to 1.10, optionally greater than or equal to 1.2, optionally greater than or equal to 1.25, optionally greater than or equal to 1.3, optionally greater than or equal to 1.35, optionally greater than or equal to 1.4, optionally greater than or equal to 1.45, and optionally greater than or equal to 1.5.

The rollers 20, 22 may include respective outer surfaces 74 and inner respective inner surfaces 76. The inner surfaces 76 may be disposed closer to the longitudinal axis 14 than the outer surfaces 74. The outer surfaces 74 of the roller 20, 22 may be spaced apart by a third dimension 78. The inner surfaces 76 of the rollers 20, 22 may be spaced apart by a fourth dimension 80. The third dimension 78 may be greater than the fourth dimension 80. In various aspects, a ratio of the third dimension 78 to the fourth dimension 80 is greater than or equal to 1, optionally greater than or equal to 1.1, optionally greater than or equal to 1.2, optionally greater than or equal to 1.3, optionally greater than or equal to 1.4, optionally greater than or equal to 1.5, optionally greater than or equal to 1.6, optionally greater than or equal to 1.7, optionally greater than or equal to 1.8, optionally greater than or equal to 1.9, and optionally greater than or equal to 2.

As described above the rollers 20, 22 are wide enough to bridge both the narrowest and the widest portions of the profile of the noncircular lip 50. Thus, the third dimension 78 of the rollers 20, 22 may be greater than or equal to the first dimension 70 of the noncircular lip 50. The fourth dimension 80 of the rollers 20, 22 may be less than or equal to the second dimension 72 of the noncircular lip 50.

Profiles of the plate 52 and noncircular lip 50, in a plane substantially perpendicular to the longitudinal axis 14, may be symmetric about two perpendicular axes. More particularly the plate 52 may be symmetric about a first transverse axis substantially parallel to the first dimension 70, and a second transverse axis substantially perpendicular to the second dimension 72. However, one skilled in the art would appreciate that other profiles are possible. In one example, the plate 52 and the noncircular lip 50 have a single axis of symmetry (see, e.g., pump 170 of FIG. 8). In another example, the plate 52 and the noncircular lip 50 do not have any axes of symmetry.

In various aspects, the roll-forming tool 10 includes exactly two rollers (e.g., the first roller 20 and the second roller 22). However, in alternative variations, a roll-forming tool may include additional rollers. For example, a roll-forming tool may optionally include three rollers, four rollers, or five rollers, each roller being radially positioned with respect to the longitudinal axis and circumferentially spaced with respect to the other rollers (not shown). Each roller may be disposed on a separate axle having a separate lateral axis (e.g., when the roll-forming tool includes three rollers, first, second, and third axles may each extend radially from a central shaft, be disposed at about 120° from one another, and include respective, first, second, and third lateral axes about which the respective first, second, and third rollers can rotate). In another example, additional rollers disposed along the axle at different radii to concurrently roll-form other nested features (not shown).

Figure 5:
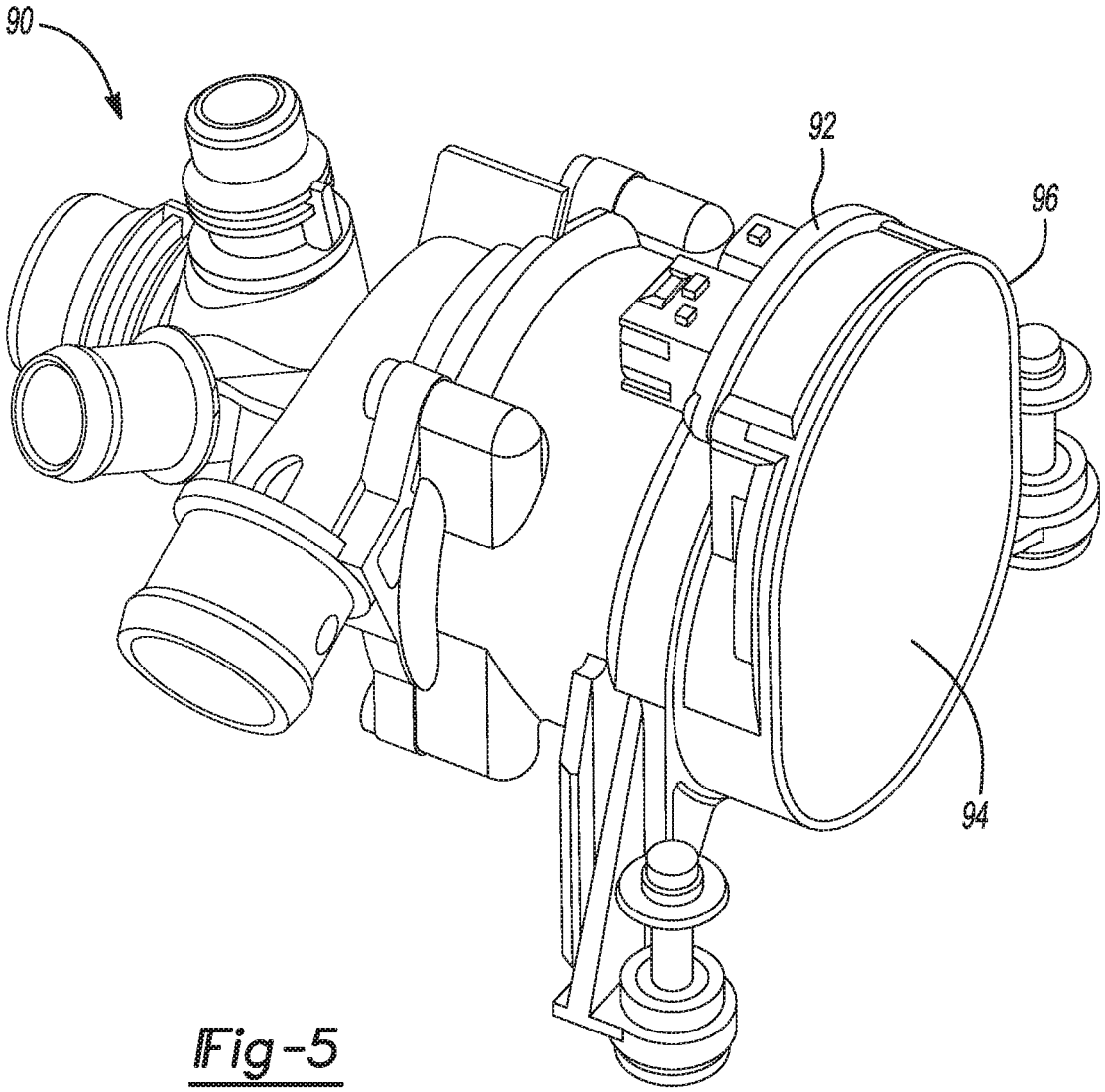
FIG. 5 is a perspective view of a pump having a housing and a cover according to certain aspects of the present disclosure.

With reference to FIG. 5, a pump 90 according to certain aspects of the present disclosure is provided. The pump 90 may include a housing 92 and a plate or cover 94. In one example, the cover 94 is a rear cover that encloses an electronics assembly (not shown) of the pump 90. The housing 92 may be cast from a molten metal or machined to final shape. The housing 92 may include a lip 96. The lip 96 may have a noncircular profile. A geometry of the lip 96 may be cast together with the housing 92 or subsequently machined into the housing 92. The cover 94 may have a noncircular geometry. In various aspects, the cover 94 comprises aluminum. The cover 94 may be stamped or laser cut. Although the cover 94 is shown as a solid, flat plate, it may include different or additional features. The cover 94 may not be flat. By way of example, the cover 94 can include stamped features, such as to increase stiffness. In another example, the cover may include one or more holes, such as for a vent that allows air, but not moisture, to pass in and out of the enclosure. The cover 94 may enclose a chamber (e.g., chamber 118 shown in FIGS. 6-7) of the pump 90. In various aspects, the pump 90 is an electric water pump (eWP). However, the pump may alternatively be any other type of pump having a noncircular joint (e.g., an electric oil pump (eOP)). Alternatively, a cover may engage a noncircular lip to at least partially enclose a chamber on other assemblies, such as a cooling fan.

Figure 6:
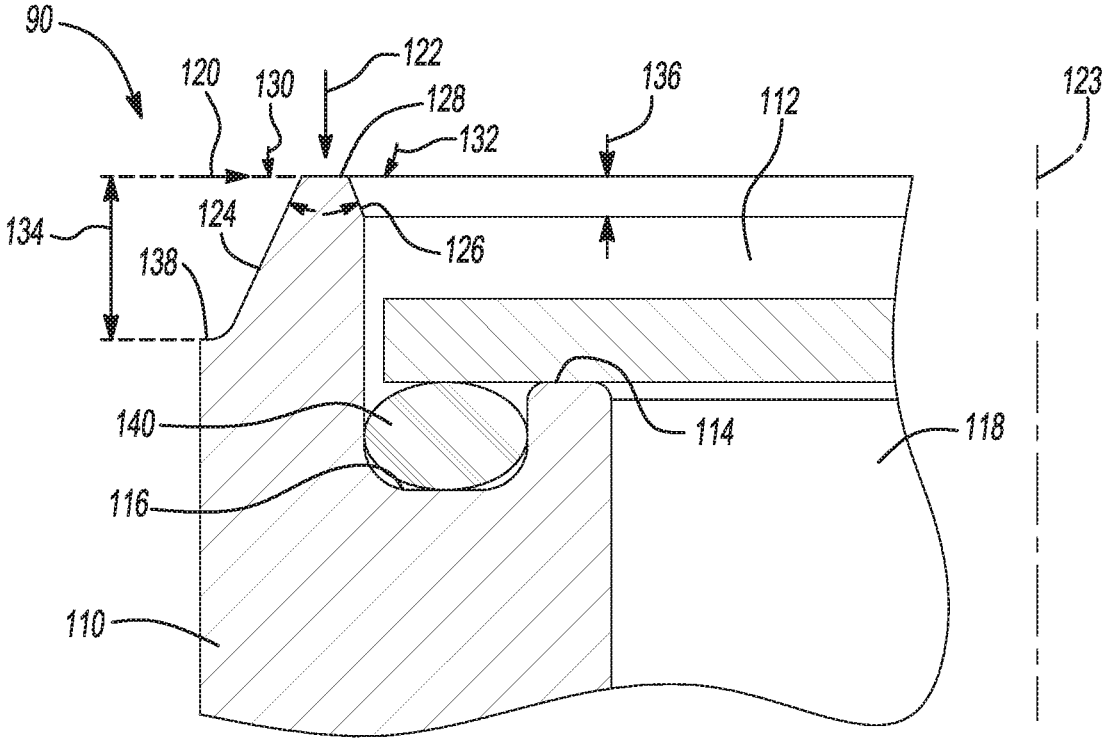
FIG. 6 is a partial sectional view of the pump of FIG. 5 showing a lip of the housing in an undeformed configuration.

Referring to FIG. 6, the housing 92 is shown with the lip 96 in an undeformed state (i.e., prior to roll-forming). The lip 96 may extend upward from a body 110 of the housing 92. The lip 96 may at least partially define a cavity 112. The housing 92 may include a first surface 114 that at least partially forms a base of the cavity 112. The first surface 114 may include a groove 116. The groove 116 may extend around an entire perimeter of the cavity 112. The cover 94 may be placed into the cavity 112 to enclose a chamber 118 into which the electronics assembly may be disposed.

The lip 96 may extend around an entire outer perimeter of the cavity 112. The lip 96 may be adapted to deform inward 120, toward a center of the cavity 112 upon the application of a force applied in a downward direction 122 (i.e., parallel to a longitudinal axis 123 of the cavity 112). The lip 96 may include a second or outer surface 124, a third or inner surface 126, and a fourth or top surface 128. The top surface 128 may extend between the outer surface 124 and the inner surface 126. The top surface 128 may be adapted to engage the rollers of a roll-forming tool (e.g., rollers 20, 22 of the roll-forming tool 10 of FIGS. 1-4). When the rollers engage the top surface 128, a longitudinal axis of the roll-forming tool (e.g., longitudinal axis 14 of FIG. 1) may be aligned with the longitudinal axis 123 of the cavity 112. Thus, the top surface 128 may extend substantially perpendicular to both the longitudinal axis 123 of the cavity 112 and the longitudinal axis of the roll-forming tool.

The outer surface 124 of the lip 96 may form a first angle 130 with the top surface 128 of the lip 96. The first angle 130 may be greater than 0° and less than or equal to about 90°. By way of example, the first angle 130 may be greater than or equal to about 60° and less than or equal to about 70°, and optionally greater than or equal to about 63° to less than or equal to about 65°. The inner surface 126 of the lip 96 may form a second angle 132 with the top surface 128 of the lip 96. The second angle 132 may be greater than 0° and less than or equal to about 90°. By way of example, the second angle 132 may be greater than or equal to about 60° and less than or equal to about 70°, optionally greater than or equal to about 67° and less than or equal to about 69°. The first and second angles 130, 132 may have different magnitudes. The first angle 130 may be less than the second angle 132. The outer surface 124 may include a first length 134 substantially parallel to the longitudinal axis 123 of the cavity 112. The inner surface 126 may include a second length 136 substantially parallel to the longitudinal axis 123 of the cavity 112. The first length 134 may be greater than the second length 136. By way of example, a ratio of the first length to the second length may be greater than 1, optionally greater than or equal to 1.5, optionally greater than or equal to 2, optionally greater than or equal to 2.5, optionally greater than or equal to 3, optionally greater than or equal to 3.5, optionally greater than or equal to 4, optionally greater than or equal to 4.5, and optionally greater than or equal to 5. A noncircular edge 138 may extend around an outer perimeter of the lip 96. In various alternative aspects, the lip 96 may include different or additional features (e.g., undercuts, perforations) that facilitate deformation in a preferred direction (e.g., inward).

The pump 90 may further include a seal 140 that is disposed at least partially within the groove 116. The seal 140 may be room-temperature-vulcanizing (RTV) silicone, an O-ring, a seal-in-place gasket, a noncircular-cross-section seal, or any other appropriate seal known to those skilled in the art. In another aspect, the cover 94 may be coated with rubber for sealing to act as a rubber-coated metal (RCM) gasket (not shown). The seal 140 may engage the cover 94.

Figure 7:
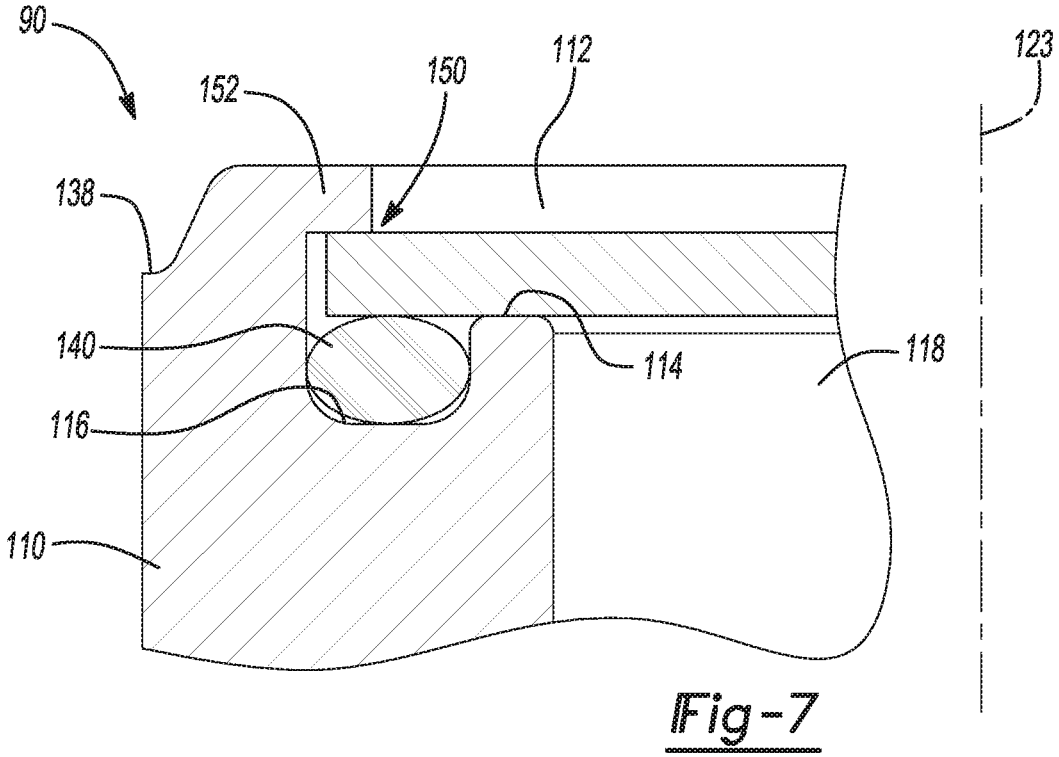
FIG. 7 is a partial sectional view of the pump of FIG. 5 showing a lip of the housing in a deformed configuration.

With reference to FIG. 7, the housing 92 is shown with the lip 96 in a deformed configuration (i.e., after roll-forming). In the deformed configuration, the lip 96 is deformed inward to engage the cover 94. Thus, the lip 96 and the cover 94 may form a joint 150 to retain the cover 94. The joint 150 may be noncircular and may extend around an interface between the lip 96 and the cover 94. The lip 96 may form a hook or inward projection 152. The cover 94 may be disposed longitudinally between the lip 96 of the housing 92 and the seal 140. The cover 94 may be disposed in the cavity 112 to enclose the chamber 118. In various aspects, the chamber 118 is hermetically sealed.

Figure 8:
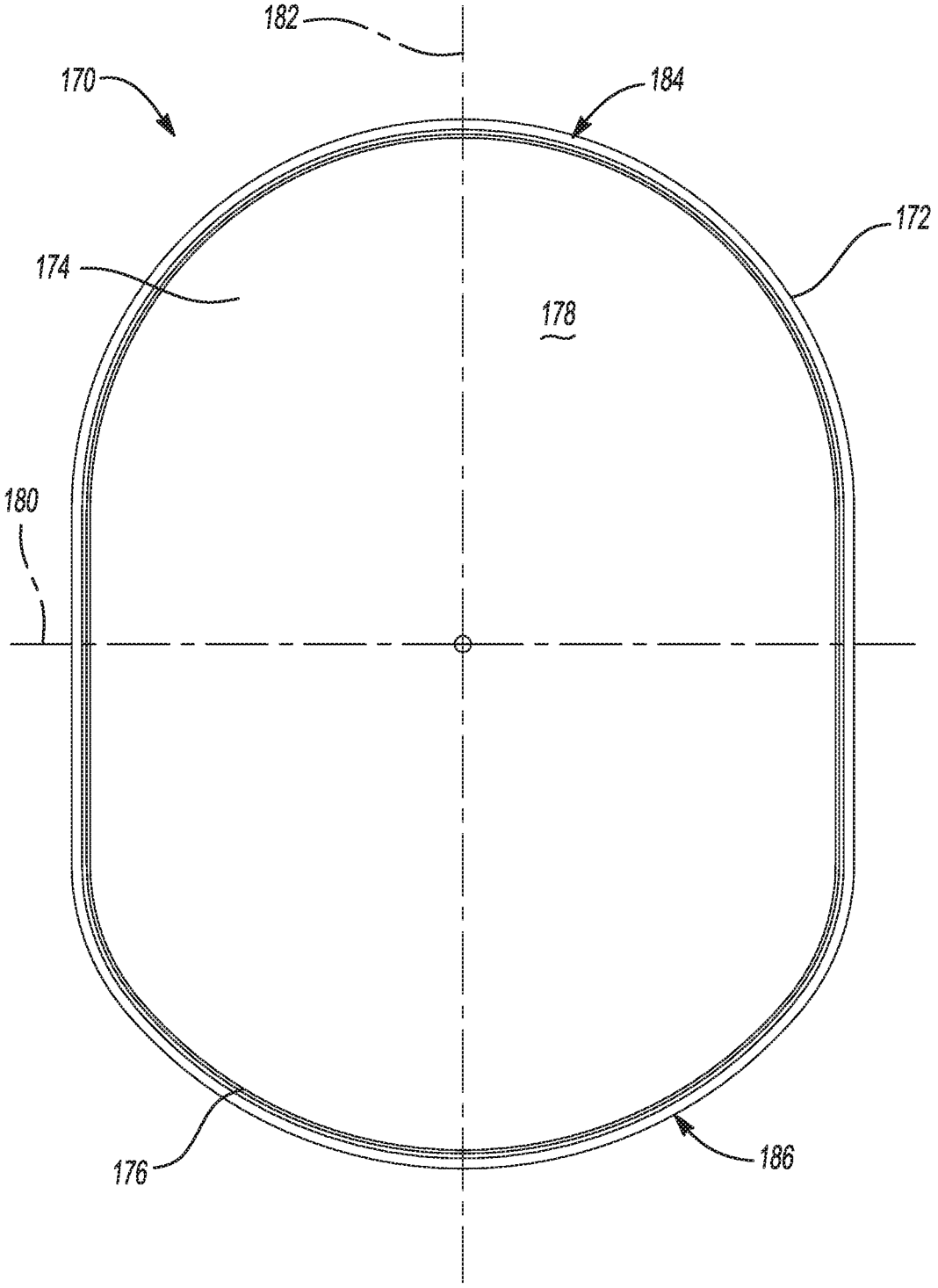
FIG. 8 is a top view of another pump according to certain aspects of the present disclosure.

Referring to FIG. 8, another pump 170 according to certain aspects of the present disclosure is provided. The pump 170 includes a housing 172 and a cover 174. The housing 172 includes a lip 176. In a deformed configuration, as shown, the lip 176 cooperates with the cover 174 to at least partially enclose a cavity (not shown) of the housing 172.

Profiles of the cover 174 and the lip 176 in a direction substantially parallel to a surface 178 of the cover 174 may be asymmetric about at least one axis. For example, the profiles of the cover 174 and the lip 176 may be substantially asymmetric about a first axis 180, and substantially symmetric about a second axis 182 substantially perpendicular to the first axis 180. More particularly, a first portion 184 may have a first radius of curvature, and a second portion 186 may have a second radius of curvature greater than the first radius of curvature. In various alternative aspects, a lip and cover define other non-circular profiles.

Figure 9:
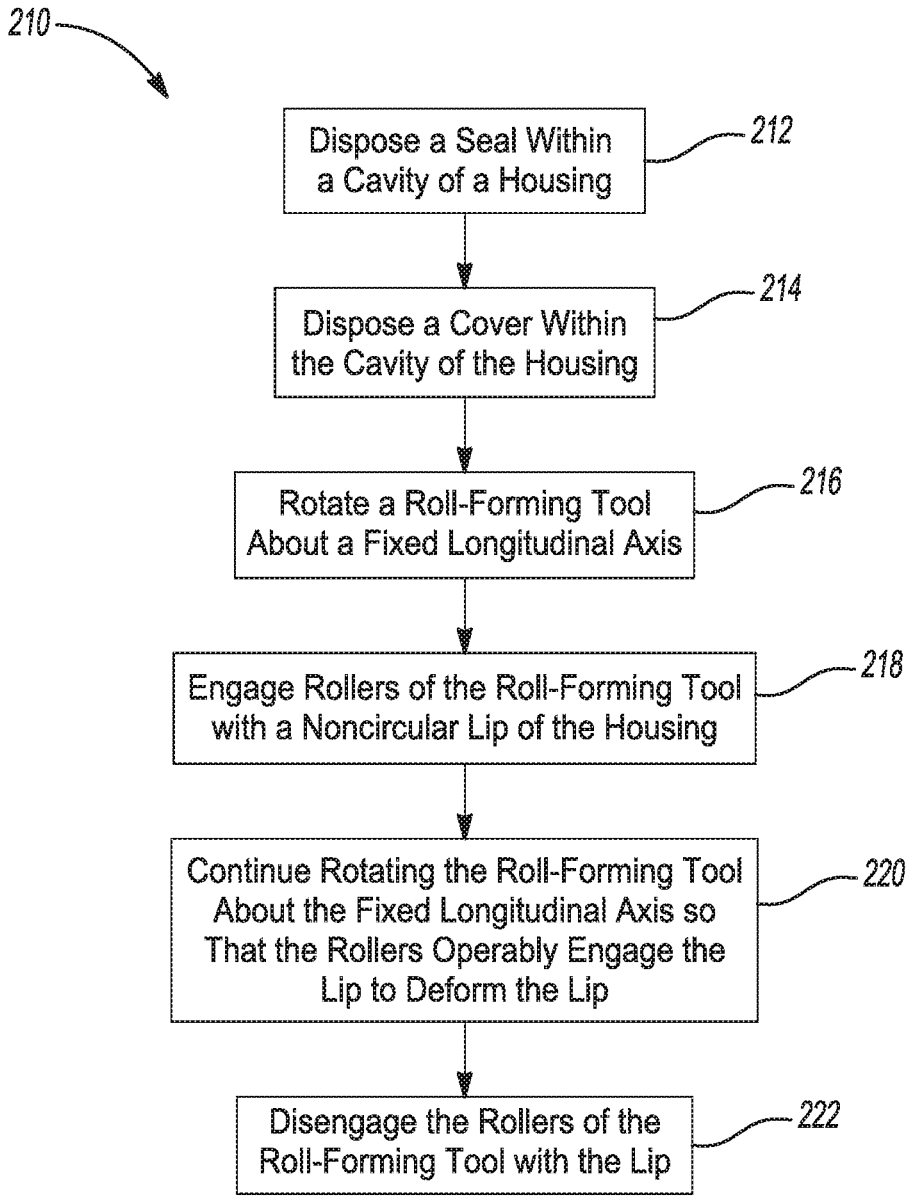
FIG. 9 is a flowchart depicting an example method of assembling the pump of FIG. 5, the method including roll-forming a joint of the pump using the roll-forming tool of FIG. 1.

The present disclosure also provides a method of roll-forming a noncircular feature, such as a joint. The method is described in the context of the pump 90 of FIGS. 5-7 and the roll-forming tool 10 of FIGS. 1-4. However, one skilled in the art will appreciate that the method may be used to roll-form any feature having a noncircular profile. An example method 210 is depicted in FIG. 9. At 212, the method may include disposing the seal 140 within the groove 116. After disposing the seal 140 in the groove 116, at 214, the cover 94 may be disposed in the cavity 112. After the cover 94 is placed in the cavity 112, the roll-forming tool 10 may be used to form the joint 150, as described in greater detail below.

At 216, the roll-forming tool 10 may be rotated about the fixed longitudinal axis 14. At 218, as the roll-forming tool 10 rotates, the first and second rollers 20, 22 may be engaged with the noncircular lip 96. More particularly, the first and second rollers 20, 22 of the roll-forming tool 10 may be operably engaged with the top surface 128 of the lip 96 of the housing 92. At 220, as the tool 10 rotates about the longitudinal axis 14, the rollers 20, 22 engage the top surface 128 to rotate about the lateral axis 18 of the axle 16. A load may concurrently be applied to the lip 96 through the tool 10 in the downward direction 122. As described above, the first and second rollers 20, 22 can maintain continuous and concurrent contact with the lip 96 as the longitudinal axis 14 of the tool 10 remains fixed during rotation of the tool 10. The operable engagement of the rollers 20, 22 with the lip 96 causes the lip 96 to deform inward 120 to transition from the undeformed configuration (FIG. 6) to the deformed configuration (FIG. 7). In the deformed configuration, the joint 150 between the lip 96 of the housing 92 and the cover 94 is formed. At 222, the rollers 20, 22 may be disengaged with the lip 96.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of deforming a noncircular lip, the method comprising:

rotating a roll-forming tool about a longitudinal axis, the roll-forming tool including a central shaft having the longitudinal axis, a first axle having a first lateral axis that extends substantially perpendicular to the longitudinal axis, a second axle having a second lateral axis that extends substantially perpendicular to the longitudinal axis, a first roller rotatably coupled to the first axle and adapted to rotate about the first lateral axis, and a second roller rotatably coupled to the second axle and adapted to rotate about the second lateral axis, the first roller and the second roller being radially positioned with respect to the longitudinal axis and circumferentially spaced with respect to each other;

while rotating the roll-forming tool, engaging the first and second rollers with the noncircular lip;

applying a load to the noncircular lip, the load being applied parallel to the longitudinal axis;

continuing rotating the roll-forming tool about the longitudinal axis, the longitudinal axis remaining in a fixed position, wherein the rotating of the roll-forming tool with the load applied causes the first and second rollers to concurrently and operably engage the noncircular lip and deform the noncircular lip, and maintaining a constant spacing between the first roller and the second roller during a complete revolution of the roll-forming tool, wherein the first axle, the second axle, the first roller and the second roller rotate together with the central shaft.

2. The method of claim 1, wherein the noncircular lip is adapted to deform inward toward a center of a cavity at least partially defined by the noncircular lip.

3. The method of claim 1, wherein:

the noncircular lip at least partially defines a first dimension substantially perpendicular to the longitudinal axis and a second dimension substantially perpendicular to the longitudinal axis, the second dimension being less than the first dimension;

the first and second rollers each include outer surfaces that are spaced apart by a third dimension and inner surfaces that are spaced apart by a fourth dimension less than the third dimension; and the third dimension is greater than or equal to the first dimension and the fourth dimension is less than or equal to the second dimension.

4. The method of claim 3, wherein a ratio of the first dimension to the second dimension is greater than or equal to about 1.2.

5. The method of claim 1, wherein:

the noncircular lip at least partially defines an undeformed shape prior to the engaging of the first and second rollers;

in the undeformed shape, the noncircular lip includes an outer surface, an inner surface, and a top surface extending between the outer surface and the inner surface, the inner surface being closer to the longitudinal axis than the outer surface; and the top surface extends substantially perpendicular to the longitudinal axis and is adapted to engage the first and second rollers.

6. The method of claim 5, wherein:

the outer surface forms a first angle with the top surface, the first angle being greater than 0° and less than or equal to about 90°;

the inner surface forms a second angle with the top surface, the second angle being greater than 0° and less than or equal to about 90°; and the first angle and the second angle are different.

7. The method of claim 6, wherein the first angle is less than the second angle.

8. The method of claim 5, wherein:

the outer surface defines a first length parallel to the longitudinal axis;

the inner surface defines a second length parallel to the longitudinal axis; and the first length is greater than the second length.

9. A system for roll-forming comprising:

a noncircular lip of a component; and a roll-forming tool comprising:

a central shaft having a longitudinal axis and being adapted to rotate about the longitudinal axis;

a first axle extending from and fixed to the central shaft, the first axle having a first lateral axis that extends substantially perpendicular to the longitudinal axis;

a second axle extending from and fixed to the central shaft, the second axle having a second lateral axis that extends substantially perpendicular to the longitudinal axis;

a first roller rotatably coupled to the first axle and adapted to rotate about the first lateral axis; and a second roller rotatably coupled to the second axle and adapted to rotate about the second lateral axis, the first and second rollers being radially spaced with respect to the longitudinal axis a predetermined constant distance during a complete revolution of the roll-forming tool, and circumferentially spaced with respect to each other, wherein the first and second rollers concurrently operably engage the noncircular lip and deform the noncircular lip.

10. The tool of claim 9, wherein:

the noncircular lip at least partially defines a first dimension substantially perpendicular to the longitudinal axis and a second dimension substantially perpendicular to the longitudinal axis, the second dimension being less than the first dimension;

the first and second rollers each include outer surfaces that are spaced apart by a third dimension and inner surfaces that are spaced apart by a fourth dimension less than the third dimension; and the third dimension is greater than or equal to the first dimension and the fourth dimension is less than or equal to the second dimension.

11. The tool of claim 10, wherein a ratio of the third dimension to the fourth dimension is greater than or equal to about 1.5.

12. The tool of claim 9, wherein the first and second rollers are disposed equidistant from the longitudinal axis.

13. The tool of claim 9, further comprising:

a third axle extending from and fixed to the central shaft, the third axle having a third lateral axis that extends substantially perpendicular to the longitudinal axis; and a third roller rotatably coupled to the third axle and adapted to rotate about the third lateral axis, the third roller being radially spaced with respect to the longitudinal axis, and circumferentially spaced with respect to the first roller and the second roller, wherein the first, second, and third rollers are adapted to concurrently operably engage the noncircular lip, and deform the noncircular lip.

* * * * *